United States Patent [19]

Gross et al.

[11] Patent Number: 4,847,948

[45] Date of Patent: Jul. 18, 1989

[54] HINGE FOR CONNECTING TWO RELATIVELY MOVABLE FURNITURE COMPONENTS

[75] Inventors: Jürgen Gross, Enger; Ulrich Beneke, Bünde, both of Fed. Rep. of Germany

[73] Assignee: Paul Hettich GmbH & Co., Kirchlengern, Fed. Rep. of Germany

[21] Appl. No.: 162,406

[22] PCT Filed: Jun. 5, 1987

[86] PCT No.: PCT/DE87/00260

§ 371 Date: Feb. 8, 1988

§ 102(e) Date: Feb. 8, 1988

[87] PCT Pub. No.: WO87/07672

PCT Pub. Date: Dec. 17, 1987

[30] Foreign Application Priority Data

Jun. 14, 1986 [DE] Fed. Rep. of Germany ... 8616146[U]
Sep. 6, 1986 [DE] Fed. Rep. of Germany ..... 3630446

[51] Int. Cl.[4] ..... E05D 11/00

[52] U.S. Cl. ..... 16/251; 16/370; 16/302; 16/DIG. 43

[58] Field of Search ..... 16/238, 240, 245, 246, 16/250, 251, 258, 370, 382, DIG. 43

[56] References Cited

U.S. PATENT DOCUMENTS 3,969,787 7/1976 Rock .
4,359,802 11/1982 Rock ..... 16/251 X

FOREIGN PATENT DOCUMENTS 8602402 4/1986 European Pat. Off. .
2658831 6/1978 Fed. Rep. of Germany ..... 16/251
3020158 12/1980 Fed. Rep. of Germany .
3119571 12/1982 Fed. Rep. of Germany .
3446594 6/1986 Fed. Rep. of Germany .

*Primary Examiner*—Fred A. Silverberg
*Attorney, Agent, or Firm*—Peter K. Kontler

[57] ABSTRACT

A hinge for connecting two relatively movable components of a piece of furniture has a housing which is mounted on one of the components and a carrier which is mounted on the other component. A link bar pivotally connects the housing to a hinge arm which is secured to a quick-mounting plate via a fastening screw. The fastening screw passes through a slotted hole of the hinge arm so that the latter can be moved longitudinally relative to the quick-mounting plate when the fastening screw is loosened. An adjusting screw is threaded into the hinge arm and allows the inclination of the hinge arm relative to the quick-mounting plate to be adjusted. One end of the quick-mounting plate is provided with a pivotable arresting member for rapidly locking the quick-mounting plate to, and rapidly releasing it from, the carrier. The arresting member has a lip which engages a projection of the carrier in the locked condition. A cover is provided for the hinge arm and is designed to overlie the fastening and adjusting screws. The cover has a protuberance which is received in an opening of the hinge arm to releasably secure the cover on such arm. The cover functions to inhibit unintentional release of the arresting member. To this end, the cover either overlies the arresting member completely or is provided with a second protuberance which prevents the arresting member from pivoting.

22 Claims, 6 Drawing Sheets

HINGE FOR CONNECTING TWO RELATIVELY MOVABLE FURNITURE COMPONENTS

BACKGROUND OF THE INVENTION

The present invention relates to a furniture hinge having a hinge arm and a housing which may be installed in a recess of a door or the like. The hinge arm is pivotally connected to the housing by means of at least one link bar and is secured to a quick-mounting plate via a fastening screw. The quick-mounting plate, in turn, is releasably connected to a support which can be fixed at the furniture side. The quick-mounting plate is provided with a spring-loaded pawl having a retaining lip which engages a projection of the support from below.

Furniture hinges of the above type are also referred to as quick-mounting hinges and are known in various forms.

A characteristic and common feature of all these furniture hinges is that the hinge arm can be adjustably secured to a quick-mounting plate which can be fixed to the support with virtually no tools. Conversely, the quick-mounting plate can again be released from the support by operating the pawl.

In practice, it is not readily possible to prevent unintentional separation of the quickmounting plate and support under certain circumstances. On the other hand, it is frequently difficult to operate the pawl when separation is desired since it is located relatively close to the inner surface of the furniture.

OBJECTS AND SUMMARY OF THE INVENTION

It is accordingly an object of the present invention to provide a furniture hinge of the preceding character which, with a most simple design, increases the reliability of this type of furniture hinge in daily use and allows intentional separation of the quick-mounting plate and support without particular difficulty.

According to the invention, the stated object is achieved in that the hinge arm is provided with a cover which overlies at least the fastening screw and, in addition, either completely covers the pawl of the quick-mounting plate or has a blocking device which is disposed in the rotational path of the pawl.

By employing a simple cover which can be manufactured economically, a furniture hinge of the foregoing type is significantly improved. On the one hand, the cover overlies the fastening screw for the hinge arm and quick-mounting plate while, on the other hand, the same cover prevents unintentional operation of the pawl which allows the quick-mounting plate to be released from the support. Thus, unintentional and undesired separation of the quick-mounting plate and support is prevented in an effective and most simple manner.

In accordance with a favorable embodiment, the cover is rotatably mounted on the pawl in the region opposite the retaining lip and the axis of rotation of the cover is parallel to and spaced from the pivot axis of the pawl. The blocking device here releases the pawl in an angular position of the cover relative to the hinge arm.

The retaining lip of the pawl is disengaged from the overlying projection by the application of tension and, in the preceding embodiment, it is of particular advantage for the cover to constitute an operating element for the pawl. Moreover, neither can mounting be forgotten nor can the cover be lost. Since, especially for furniture which is assembled by the buyer, the sections of the hinge are already secured to the components of the furniture, this makes it unnecessary to supply the cover separately. Furthermore, the cover can be attached during production of the hinge so that the buyer receives a fully installed hinge. The side of the cover which faces the hinge arm can be provided with instructions in the form of letters or symbols.

Advantageously, a stationary abutment is located on the side of the pawl opposite the retaining lip and the corresponding end face of the cover bears against this abutment when the cover is brought into an angular position relative to the hinge arm.

In this manner, the retaining lip is disengaged from the projection upon movement of the cover into an angular position so that no further forces need be applied to separate the quick-mounting plate and support.

Other characteristics and features of the present invention will be apparent from the following description of preferred embodiments with reference to the accompanying drawings.

DESCRIPTION OF THE PREFERRED EMBODIMENTS

Figure 1:
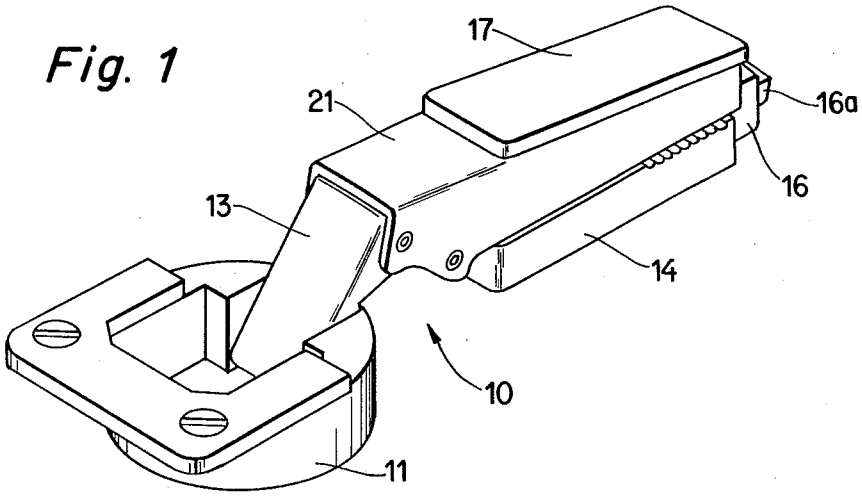
FIG. 1 is a perspective view of a furniture hinge according to the invention.

The furniture hinge illustrated in FIG. 1 and generally identified by the reference numeral 10 consists essentially of a housing 11, a hingearm 12, a link bar 13, a support 14 and a quick-mounting plate 15 with a pawl 16*a* and a cover 17.

Figure 2:
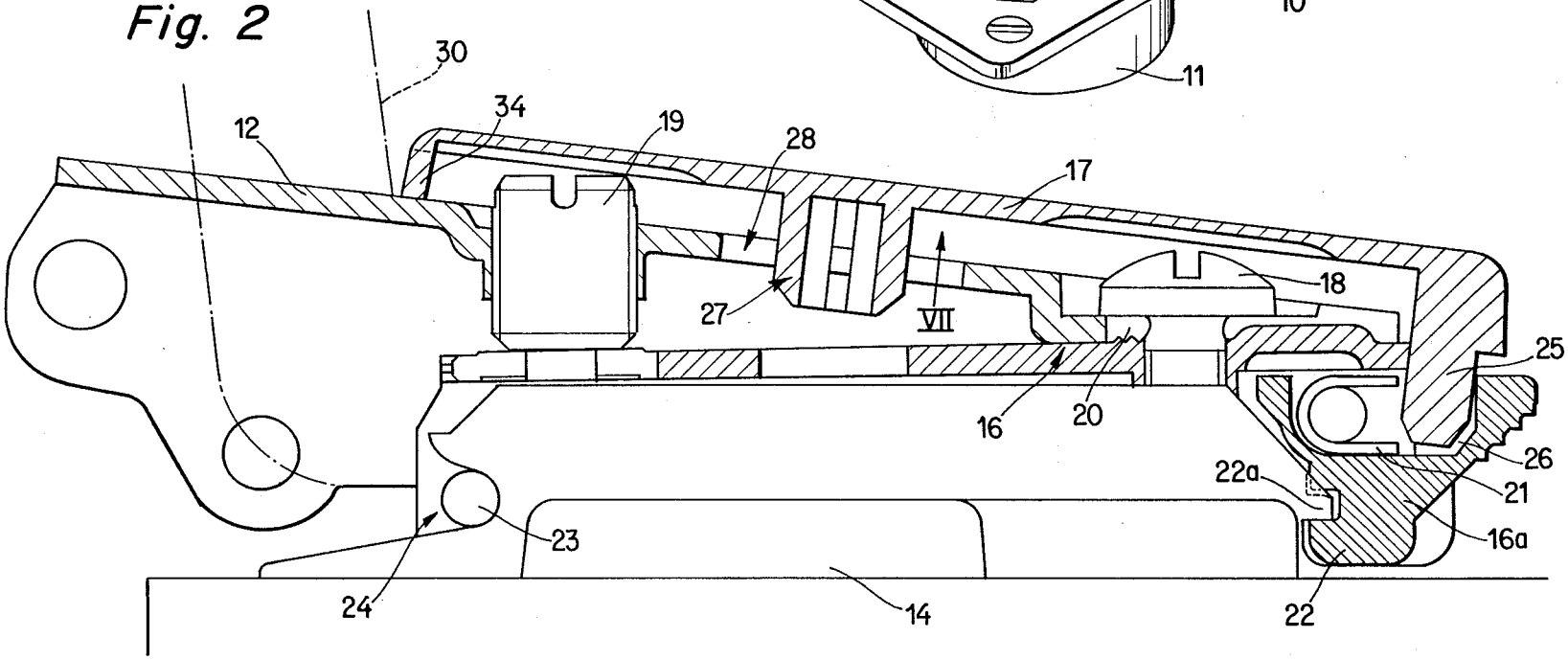
FIG. 2 is a longitudinal section through the hinge arm of the furniture hinge of FIG. 1.

As shown particularly clearly in FIG. 2, the hinge arm 12 is connected to the quick-mounting plate 16 by means of a fastening screw 18.

The height of the hinge arm 12 relative to the quick-mounting plate 16 can be adjusted via an adjusting screw 19.

The fastening screw 18 passes through a slotted hole or slit 20 in the hinge arm 12 so that it is also possible to longitudinally adjust the hinge arm 12 and quick-mounting plate 16 relative to one another.

FIG. 2 shows further that the pawl 16*a* is biased via a spring 21 and is provided with a retaining lip 22 which engages a projection 22*a* of the support 14 from below.

Moreover, the quick-mounting plate 16 is provided with a shaft 23 which extends into a cutout 24 of the support 14. This cutout 24 is located at the front end of the support 14 opposite the projection 22*a* so that, in the assembled condition, the quick-mounting plate 16 is reliably affixed to the support 14 via the shaft 23 and the pawl 16*a* with its retaining lip 22.

As is also clearly shown in FIG. 2, the cover 17 overlies the hinge arm 12 in such a manner that the adjusting screw 19 as well as the fastening screw 18 are covered. In addition, the cover 17 is provided with a protuberance 25 which projects into a recess 26 of the pawl 16*a*. In the position illustrated in FIG. 2, the protuberance 25 prevents operation of the pawl 16*a* in a sense releasing the pawl from the support 14 so that the protuberance 25 can very generally also be referred to as a blocking device.

By virtue of this construction—as already mentioned—unintentional separation of the hinge arm 12 and the quick-mounting plate 16 from the support 14 is prevented. Only after removal of the cover 17 is the rotational path of the pawl 16*a* again free so that now the hinge arm 12 together with the quick-mounting plate 16 can be deliberately disassembled from the support 14.

In the embodiment of FIG. 2, the cover 17 is provided with an expandable protuberance 27 which is positively engaged in a slotted hole 28 of the hinge arm 12.

The protuberance 25 of the cover 17, which extends into the recess 26 of the pawl 16, can be dimensioned such that it is received in the mentioned recess 26 with a light press fit. Similarly, the protuberance 25 can be in the form of an expandable protuberance so that the protuberance 25 is reliably fixed in the recess 26.

Figure 7:
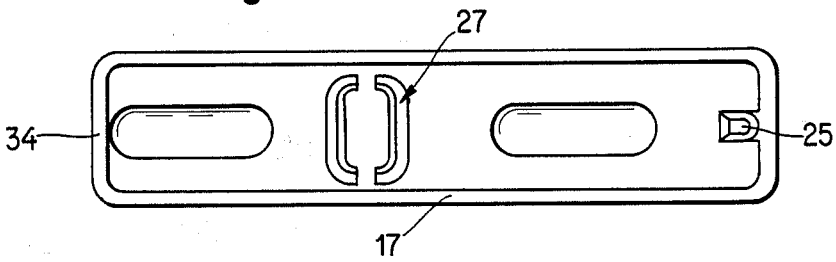
FIG. 7 is a view of a cover as seen in the direction of the arrow VII of FIG. 2.
Figure 8:
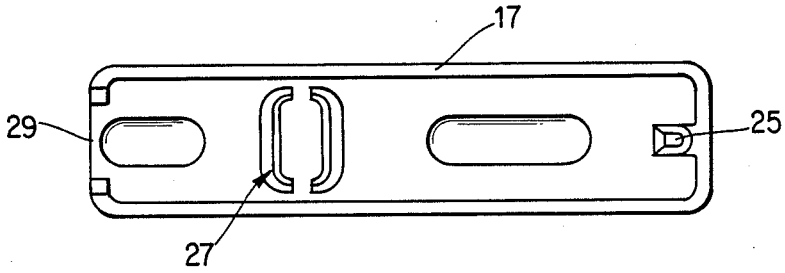
FIG. 8 is a view similar to that of FIG. 7 of another embodiment of a cover according to the invention.

As is clear from FIG. 2 in combination with FIG. 7, the end of the cover 17 which faces away from the pawl 16*a* is provided with a closed marginal ledge 34 which lies directly on the hinge arm 12. In the embodiment of a cover according to FIG. 8, this end of the cover 17 is provided with a slit 29 which can be necessary when the hinge arm 12 is bent and the distance between the adjusting screw 19 and the bent zone 30 of the hinge arm 12, shown in FIG. 2 by dash-and-dot lines, is relatively small. During longitudinal adjustment of the hinge arm 12 relative to the quick-mounting plate 16, there may be an intermediate position in which the cover 17 no longer completely overlies the adjusting screw 19 thereby resulting in the requirement for the slit 29.

Figure 3:
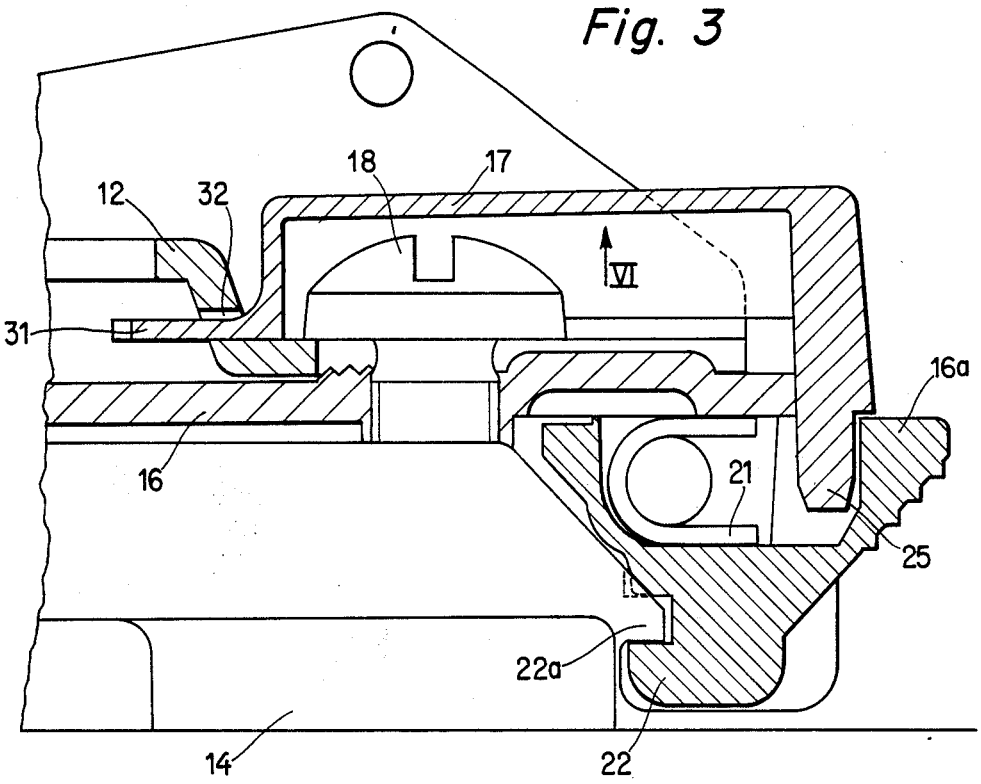
FIG. 3 is a fragmentary longitudinal section through the rear part of a hinge arm of another embodiment of a furniture hinge in accordance with the invention.
Figure 6:
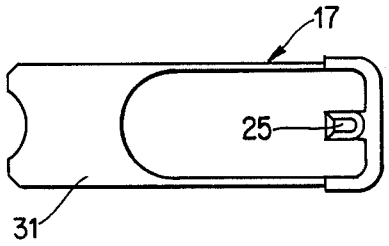
FIG. 6 is a view of a cover as seen in the direction of the arrow VI of FIG. 3.

FIG. 3 illustrates that, when a hinge arm 12 is appropriately designed, one side of the cover 17 may be provided with a tongue 31 which, in order to be fixed to the hinge arm 12, is inserted in a slit 32 of the hinge arm 12. The cover 17 shown in FIG. 3 is illustrated once more in FIG. 6 as seen in the direction of the arrow VI.

Figure 4:
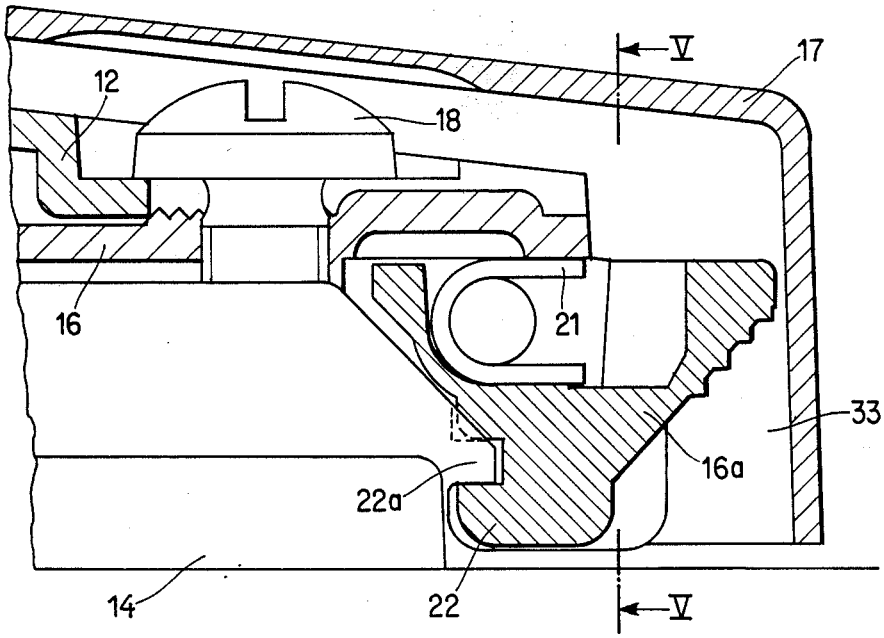
FIG. 4 is a section similar to that of FIG. 3 for a further embodiment of the invention.
Figure 5:
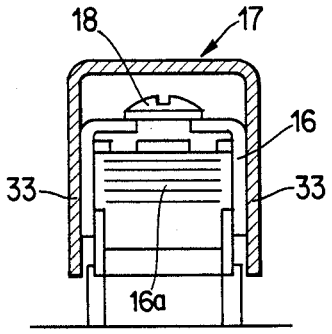
FIG. 5 is a section per the line V—V of FIG. 4.

FIGS. 4 and 5 illustrate an embodiment of the invention in which the cover 17 overlies the pawl 16a completely and, in this manner, prevents unintentional operation of the pawl 16*a*.

As is particularly clearly seen in FIG. 5, the portion of the cover which overlies the pawl 16*a* is U-shaped and the two lateral legs 33 are pressed onto the corresponding sides of the quick-mounting plate 16 with a light clamping action. Similarly, the respective free ends of the lateral legs 33 can be provided with small locking projections which, in the installed condition of the cover 17, engage the quick-mounting plate 16 from below.

Figure 9:
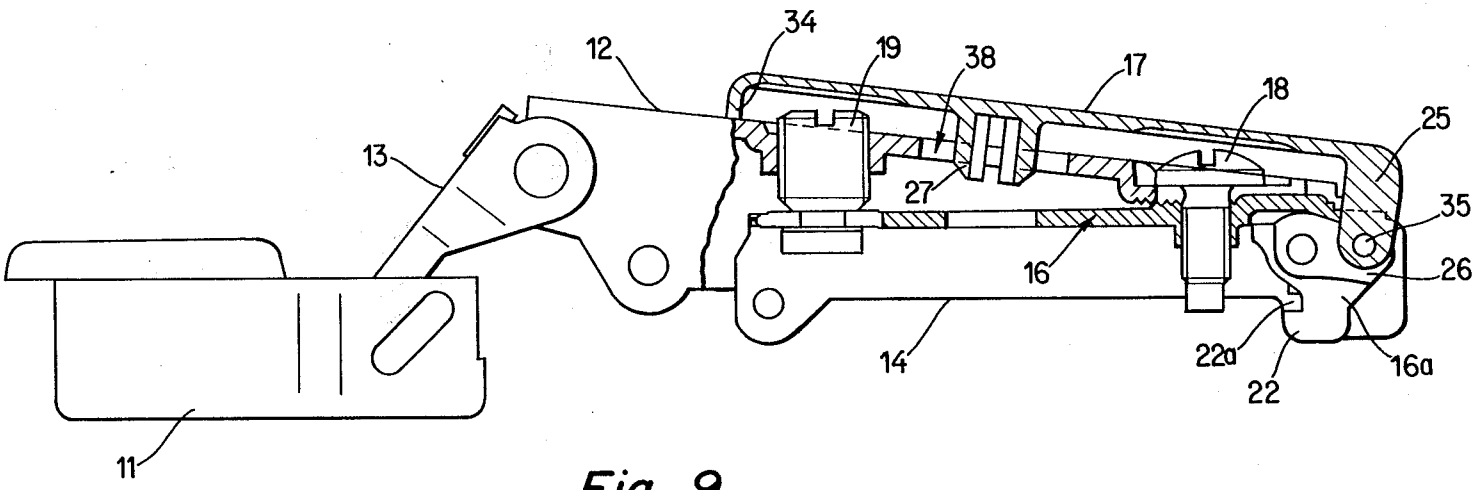
FIG. 9 is a partly sectional view of an additional embodiment with a rotatable cover.
Figure 10:
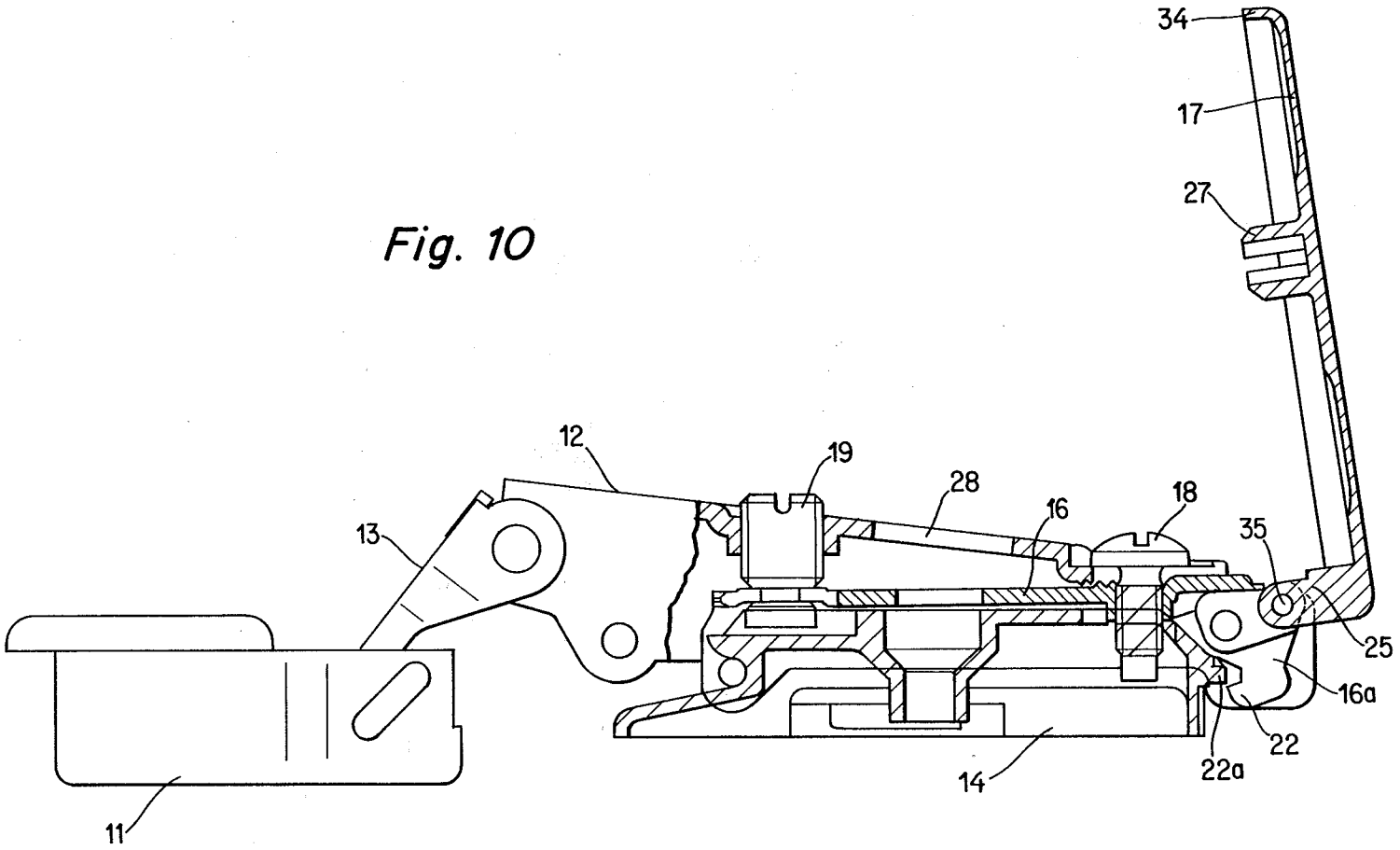
FIG. 10 is a view similar to that of FIG. 9 but with the cover positioned at an angle to the hinge arm and FIG. 11 is a view similar to that of FIG. 10 but with an abutment associated with the pawl.
Figure 11:
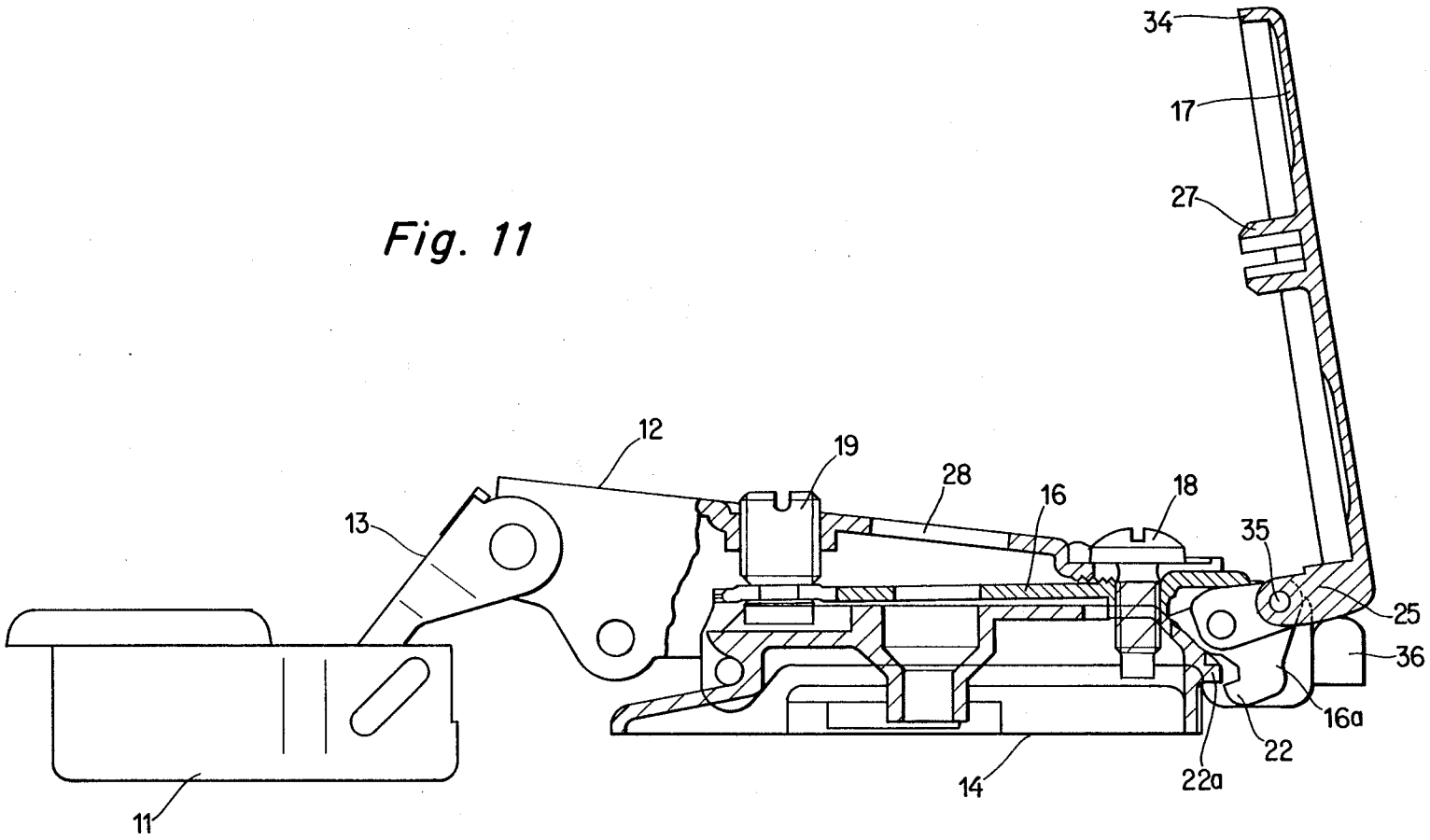

In the embodiments illustrated in FIGS. 9 to 11, the cover 17 is rotatably mounted on the pawl 16*a*. To this end, the outer side of the pawl 16*a* which faces away from the fastening screw 18 is fork-shaped in these embodiments. The lateral webs formed in this manner are provided with two mutually aligned bores which receive a pin 35 rotatably supporting the cover 17. The protuberance 25 is provided with a corresponding bore for this purpose. In the illustration of FIG. 9, the cover 17 is parallel to the hinge arm 12 and the pawl 16*a* is in the blocked position. In the illustration of FIG. 10, the cover 17 is in an angular position relative to the hinge arm 12. Furthermore, a force is applied to the cover 17 in a direction such that the retaining lip 22 of the pawl 16*a* is brought out of engagement with the projection 22*a*. As can be seen from FIG. 10, the quick-mounting plate 16 can then be removed from the support 14. Consequently, the cover not only has a safety function but simultaneously constitutes a handle for the pawl 16*a*. The embodiment of FIG. 11 differs from the embodiment of FIGS. 9 and 10 in that two parallel, spaced cams 36 are affixed to the quick-mounting plate 16 at the outer side corresponding to the pin 35 and define a stationary abutment for the respective end face of the cover 17 during transfer into the angular position. As is clearly shown in FIG. 11, the pawl 16*a* is released via the cams 36 when the cover 17 is moved to the angular position. Therefore, no additional force need be applied for release.

It is pointed out that the manner of applying the cover 17 to the pawl 16*a* depends upon the particular form of the cover 17. It is further conceivable to eliminate the continuous pin 35 and, for example, to lock the protuberance 25 into projecting lugs by appropriate design of the protuberance 25. Advantageously, however, the cover 17 is applied to the pawl 16*a* in a form-fitting manner so that an undesired withdrawal upon actuation is prevented. In contrast to the illustrations of FIGS. 9 to 11, it is also conceivable to make the protuberance 25 of the cover 17 fork-shaped and to provide the pawl 16*a* with a protuberance. In contrast to the embodiments of FIGS. 2 to 8, the pawl 16*a* in the embodiment of FIGS. 9 to 11 is designed such that the surface facing away from the respective edges of the support 16.

The cover 17 is favorably of one piece and can be advantageously manufactured using the synthetic resin injection molding process or the zinc pressure casting process.

We claim:

1. A furniture hinge, comprising an arm for establishing a connection between two relatively movable furniture parts, said arm having an opening; a support designed to be mounted on one of the furniture parts; a mounting element designed to mount said arm on said support and including a pivotable arresting member for releasably connecting said element to said support, said member having a recess, and said member being movable between a first position in which said element is coupled to said support and a second position in which said element is removable from said support; and a device for inhibiting unintentional movement of said member from said first position to said second position when said member couples said element to said support, said device including a first protuberance receivable in said recess to thereby inhibit unintentional movement of said member, and said device including an expandable second protuberance designed to be frictionally received in said opening.

2. The hinge of claim 1, wherein said opening is elongated.

3. A furniture hinge, comprising an arm for establishing a connection between two relatively movable furniture parts, said arm having a slot, a support designed to be mounted on one of the furniture parts; a mounting element designed to mount said arm on said support and including a pivotable arresting member for releasably connecting said element to said support, said member having a recess, and said member being movable between a first position in which said element is coupled to said support and a second position in which said element is removable from said support; and a device for inhibiting unintentional movement of said member from said first position to said second position when said member couples said element to said support, said device including a projection receivable in said slot and a protuberance receivable in said recess to thereby inhibit unintentional movement of said member, said slot and said recess being spaced from one another and said device extending between said slot and said recess, said device having a first end which is located in the region of said slot and is provided with said projection and a second end which is located in the region of said recess and is provided with said protuberance.

4. The hinge of claim 3, wherein said projection is expandable and is designed to be received in said slot with a press fit.

5. The hinge of claim 3, wherein said device is pivotally mounted on said member.

6. A furniture hinge, comprising an arm for establishing a connection between two relatively movable furniture parts; a support designed to be mounted on one of the furniture parts; a mounting element designed to mount said arm on said support and including a pivotable arresting member for releasably connecting said element to said support, said member having a first pivot axis, and said member being movable between a first position in which said element is coupled to said support and a second position in which said element is removable from said support; and a device for inhibiting unintentional movement of said member from said first position to said second position when said member couples said element to said support, said device being pivotally mounted on said member and having a second pivot axis, said first pivot axis and said second pilot axis being spaced from, and being substantially parallel to, one another.

7. The hinge of claim 6, further comprising a housing designed to be mounted on the other of the furniture parts, and a link for pivotally connecting said arm and said housing to one another.

8. The hinge of claim 6, wherein said element comprises a quick-mounting plate.

9. The hinge of claim 6, further comprising a biasing element for urging said member towards said first position.

10. The hinge of claim 6, wherein said member has a lip and said support has a projection which engages said lip in said first position to thereby couple said element to said support.

11. The hinge of claim 6, further comprising a fastener for connecting said arm to said element, said device including a cover for said fastener.

12. The hinge of claim 11, wherein said cover has a part designed to arrest, and thereby inhibit unintentional movement of, said member.

13. The hinge of claim 6, wherein said arm has an opening and said device includes a protuberance receivable in said opening.

14. The hinge of claim 6, further comprising an adjusting element for effecting relative displacement of said arm and said mounting element towards and away from one another, said device including a cover for said adjusting element.

15. The hinge of claim 6, wherein said device includes a cover for said arm and said cover has a part designed to arrest, and thereby inhibit unintentional movement of, said member, said cover having one position in which said cover overlies said arm and said part arrests said member, and said cover having another position in which said cover is swung away from said arm and said part permits movement of said member.

16. The hinge of claim 15, wherein said member has opposed first and second sides, said first side having a lip and said support having a projection which engages said lip in said first position of said member to thereby couple said element to said support, said device being mounted in the region of said second side.

17. The hinge of claim 15, further comprising an abutment adjacent to said member, said cover having an end face which is arranged to contact said abutment in said other position of said cover.

18. The hinge of claim 17, wherein said member has opposed first and second sides, said first side having a lip and said support having a projection which engages said lip in said first position of said member to thereby couple said element to said support, said abutment being located adjacent to said second side.

19. The hinge of claim 17, wherein said abutment comprises a pair of spaced, substantially parallel cam elements.

20. The hinge of claim 19, wherein said cam elements are fixed to said mounting element.

21. The hinge of claim 6, wherein said member has a fork-like portion defining a pair of spaced legs; and further comprising a pin bridging said legs, said device being pivotally mounted on said pin.

22. The hinge of claim 6, wherein said device and said member are in form-fitting engagement.

* * * * *